US005990774A

United States Patent [19]

Leupold

[11] Patent Number: 5,990,774

[45] Date of Patent: Nov. 23, 1999

[54] RADIALLY PERIODIC MAGNETIZATION OF PERMANENT MAGNET RINGS

[75] Inventor: Herbert A. Leupold, Eatontown, N.J.

[73] Assignee: The United States of America as represented by the Secretary of the Army, Washington, D.C.

[21] Appl. No.: 09/186,740

[22] Filed: Nov. 5, 1998

[51] Int. Cl.[6] ..... H01F 7/02

[52] U.S. Cl. ..... 335/306

[58] Field of Search ..... 335/302–306; 324/318–320; 315/5.34, 5.35

[56] References Cited

U.S. PATENT DOCUMENTS

| | | | |
|---|---|---|---|
| H0591 | 3/1989 | Leupold . | |
| 4,831,351 | 5/1989 | Leupold et al. . | |
| 4,835,137 | 5/1989 | Leupold . | |
| 4,859,976 | 8/1989 | Leupold | 335/306 |
| 4,887,058 | 12/1989 | Leupold . | |
| 5,028,902 | 7/1991 | Leupold . | |
| 5,075,662 | 12/1991 | Leupold et al. . | |
| 5,103,200 | 4/1992 | Leupold . | |
| 5,216,400 | 6/1993 | Leupold . | |
| 5,216,401 | 6/1993 | Leupold . | |
| 5,280,209 | 1/1994 | Leupold et al. . | |
| 5,309,055 | 5/1994 | Leupold et al. | 310/178 |
| 5,319,340 | 6/1994 | Leupold | 335/306 |
| 5,337,472 | 8/1994 | Leupold et al. . | |
| 5,349,258 | 9/1994 | Leupold et al. . | |
| 5,382,936 | 1/1995 | Leupold et al. . | |
| 5,428,334 | 6/1995 | Leupold et al. . | |
| 5,428,335 | 6/1995 | Leupold et al. . | |
| 5,491,459 | 2/1996 | Leupold . | |
| 5,666,097 | 9/1997 | Leupold . | |

*Primary Examiner*—Michael L. Gellner
*Assistant Examiner*—Raymond Barrera
*Attorney, Agent, or Firm*—Michael Zelenka; John M. O'Meara

[57] ABSTRACT

The invention is a magic sphere having an equatorial gap, with a radial magnetic field in the equatorial gap. The radial magnetic field can flow inward, toward the center of the magic sphere, or outward, away from the magic sphere. In a further embodiment, the magic sphere produces a periodically radial magnetic field. In another embodiment, a magic sphere with an azimuthally periodic radial magnetic field that flows in the outward direction periodically magnetizes a magnetically hard ring in the outward direction. Then, a magic sphere with an azimuthally periodic radial magnetic field that flows inwardly, periodically magnetizes the ring in the inward direction. The result is a permanent magnet that has a radial magnetic field, where the direction of the field periodically alternates from the inward to the outward direction.

9 Claims, 9 Drawing Sheets

RADIALLY PERIODIC MAGNETIZATION OF PERMANENT MAGNET RINGS

GOVERNMENT INTEREST

The invention described herein may be manufactured, used, imported, licensed, and sold by or for the Government of the United States of America without the payment of any royalties to the inventor.

FIELD OF THE INVENTION

The invention generally relates to a periodic magnetizer for magnetically hard materials. In particular, the invention relates to a set of magic spheres, each of which produce a radially periodic magnetic field, and together can periodically magnetize a ring so that the ring has a radial magnetization that periodically alternates in direction.

BACKGROUND OF THE INVENTION

Electric motors and generators frequently employ radially oriented permanent magnets in their rotors or stators that are alternately magnetized inward and outward. Usually these are assembled from individually manufactured, block magnets arranged in a circle about the rotational axis of the rotor. In more sophisticated configurations the magnetic ring consists of arched circular segments that are fitted together to form an annular ring. Such a configuration is still not ideal, however, because each individual segment has unidirectional magnetization and hence only along its central radius is the magnetization truly radial.

Alternatively, a magnetic ring can generate a nearly radial magnetic field by making the angular width of the individual segments relatively small. This involves much individual magnetization and assembly and is usually not cost effective or convenient. On the other hand if one-piece magnetization of the entire ring is done, the strength of the magnetic field around the ring is very small if the magnetization is attempted by traditional means, especially in rings of short period where adjacent magnets tend to cancel each other's fields and where the necessary magnetizing field strengths are difficult to obtain, again because of mutual cancellation of adjacent magnetizers. This problem could be overcome by using a stronger magnetizing field, but this is as hard to affect as is the magnetization itself.

The purpose of this invention is to obtain much greater field strength in a one-piece periodic ring magnetizer than is traditionally available. Very high radial fields are available from two northern or two southern hemispheres of a magic sphere joined at their equatorial planes. In the former case the radial field at the equator is outwardly directed and in the former case inwardly directed.

SUMMARY OF THE INVENTION

The invention is a magic sphere having an equatorial gap, that produces a radial magnetic field in the equatorial gap. The radial magnetic field can flow inward, toward the center of the magic sphere, or outward, away from the magic sphere. In a further embodiment, the magic sphere produces a periodically radial magnetic field. In another embodiment, a magic sphere with an azimuthally periodic radial magnetic field that flows in the outward direction periodically magnetizes a magnetically hard ring in the outward direction. Then, a magic sphere with an azimuthally periodic radial magnetic field that flows inwardly, periodically magnetizes the ring in the inward direction. The result is a permanent magnet that has a radial magnetic field, where the direction of the field periodically alternates from the inward to the outward direction.

DETAILED DESCRIPTION OF THE INVENTION

Magnetically Hard Materials

Fabrication of complex magnetic structures has been facilitated by the advent of magnetically hard materials. A magnetically hard material is a material that maintains essentially full magnetization against large opposing magnetic fields. This "hard material" is also known as a material that has a high coercivity. The coercivity of a material describes the strength of opposing magnetic field that is needed to change the magnetization of a material. Materials that are magnetically hard, or highly coercive, include neodymium iron boride, samarium cobalt, platinum cobalt, and samarium cobalt alloys, together with selected ferrites.

By contrast, a metal such as iron is magnetically soft, because iron has a very low coercivity. In other words, a very small magnetic field will change the magnetization of iron. As copper is a conductor of electricity, iron is a "conductor" of magnetism. Copper provides very small electrical resistance to an electric current. Similarly, iron provides very little reluctance to a magnetic field. Iron therefore is a magnetically soft material.

Magic Ring

The ideal magic ring is an infinitely long, annular cylindrical shell which produces an intense magnetic field in its interior working space. The direction of the magnetic field in the working space interior is perpendicular to the long axis of the cylinder. However, it is presently impossible to magnetize and orient a ring shaped cylinder in a continuous manner to create the ideal magic ring. Fortunately, a good approximation is fairly easy to build. A magic ring with sixteen sides produces an interior magnetic field equal to 99 percent of the field produced by the ideal structure. A coarser eight-sided magic ring still produces an interior field that is as strong as 92 percent of the continuous ideal. Therefore, the term magic ring encompasses the ideal cylindrical structure with a circular cross section as well as eight-sided and higher order polygonal-sided structures that approximate the ideal magic ring.

FIGS. 1A through 1E illustrate the magic ring. There are several methods of making magic rings, as described in Statutory Invention Registration H591 issued to Leupold, U.S. Pat. No. 5,634,263 issued to Leupold, and U.S. Pat. No. 5,337,472 issued to Leupold et al., all of which are incorporated herein by reference. One example of making a magic ring will now be described.

Figure 1A:
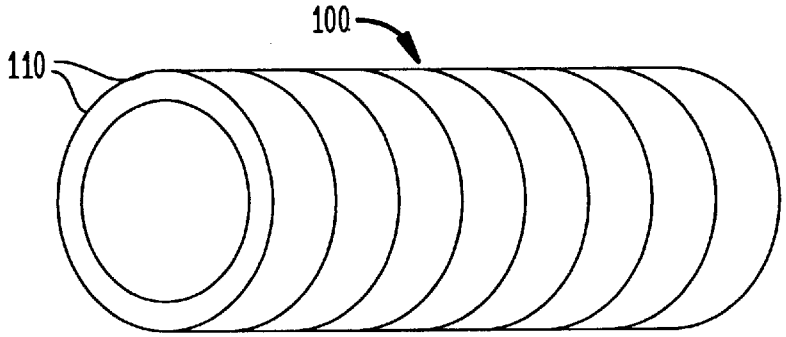
FIGS. 1A–1E show the construction of a magic ring.
Figure 1B:
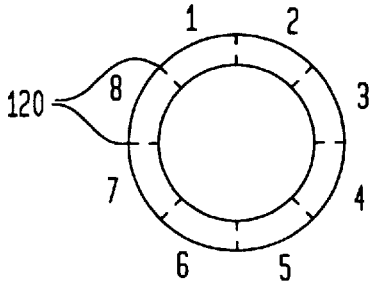
Figure 1C:
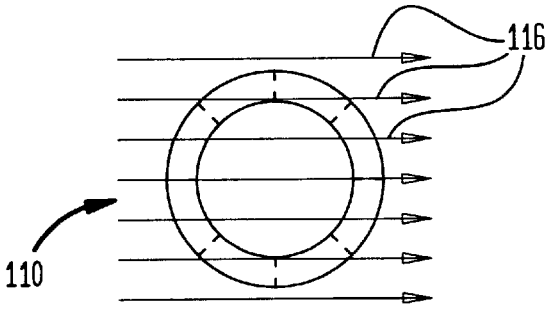
Figure 1D:
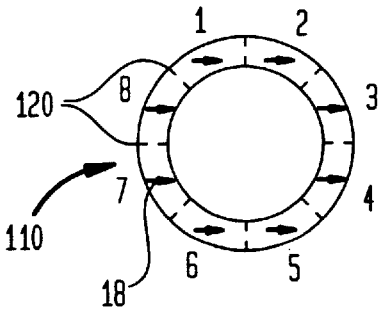

A ring 110 is formed by laterally cutting a cylinder 100 into a plurality of rings. The ring 110 is made of a magnetically hard material. Each ring is then further radially cut into 8, 16, 32, or a larger number of segments. For convenience, FIG. 1B shows that the ring 110 is cut into eight sections 1–8. Each section is the same size. Thus, in FIG. 1, the angular span of each section is 360°/8=45°. The material is then magnetized in an external uniform magnetic field represented by arrows 16. After magnetization, the sections 1–8 have a magnetic orientation illustrated by arrows 18 as shown in FIG. 1C. The sections 1–8 of the magnetically hard material retain their magnetization 18 even after the external field 16 is removed, as shown in FIG. 1D.

Figure 1E:
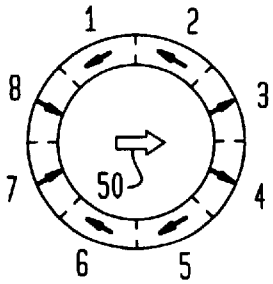

The sections 1–8 are then rearranged as illustrated in FIG. 1E. Section 1 is exchanged with section 6. Section 2 is exchanged with section 5. Sections 3 and 4 are exchanged. Sections 7 and 8 are exchanged. The resulting structure is illustrated in FIG. 1E. This is a magic ring that has an intense internal magnetic field 50 within its interior working space.

If this magic ring were infinitely long, the magnetic field 50 in the interior of the ring 110 would be uniform within the interior. However, this magic ring is not an ideal magic ring that is infinitely long. Use of this ring in real world applications such as electronic devices demands that the length of the ring must be limited. Because each of the segments has a finite length, there is considerable distortion of the interior magnetic fields. The field inside the ring is not uniform because of this distortion. There is also flux leakage from the interior to the exterior of the ring.

Magic Sphere

One device which eliminates the distortion and flux leakage of the magic ring without increasing the length of the ring to infinity is called the magic sphere. The magic sphere is a magic ring section that is theoretically "rotated" 360 degrees about its axis to trace out a sphere. Thus, the radius of the resulting magic sphere is the same as that of the initial magic ring. However, the internal magnetic field of the magic sphere is substantially greater than that of the magic ring, and the internal field of the magic sphere is uniform.

Figure 2A:
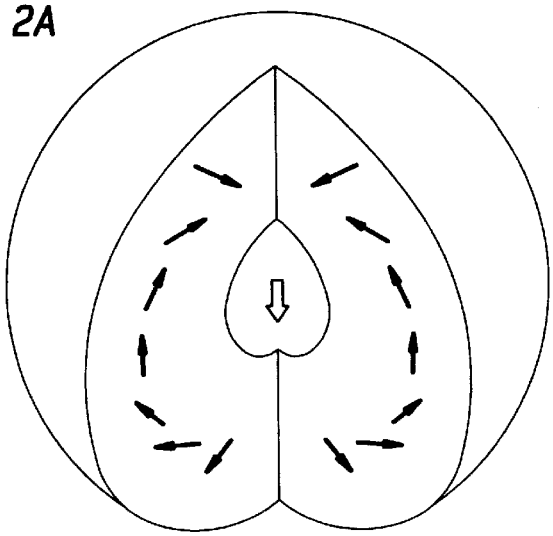
FIGS. 2A–2H show the construction of a magic sphere.
Figure 2B:
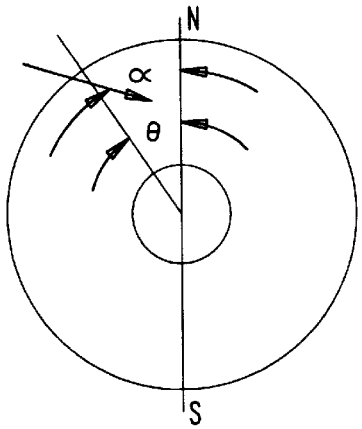

FIG. 2A illustrates an ideal, hollow magic sphere. A portion of the sphere has been removed so that the interior can be seen. The large arrow designates the uniform high field in the central cavity which, of course, is a spherical hole. The hollow sphere is comprised of magnetically hard material and its magnetization is azimuthally symmetrical. The small arrows in FIG. 2A indicate the magnetization orientation at various points. The magnetic orientation in the spherical permanent magnet shell is given by the equation $$\alpha=2\theta$$

where $\theta$ is the polar angle. These values $(\alpha,\theta)$ are shown in the geometric illustration of FIG. 2B. The strength of the field inside of the working space is $$Hw=4/3Br\ ln(ri/ro)$$

This field is 4/3 times as strong as the field of a long magic ring. Also, the magic sphere does not have the distortions due to end effects that the magic ring has.

Figure 2C:
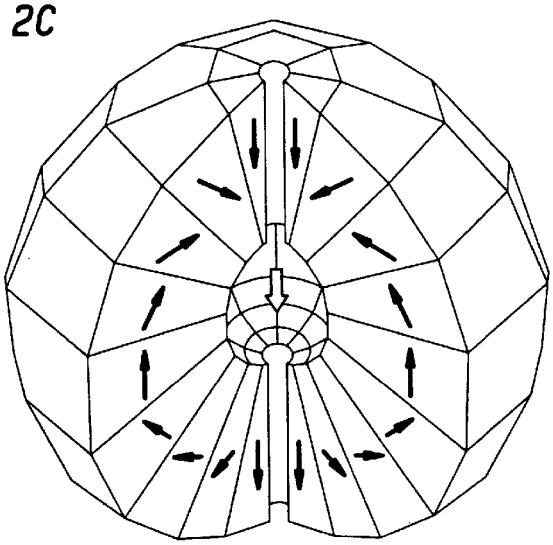
Figure 2D:
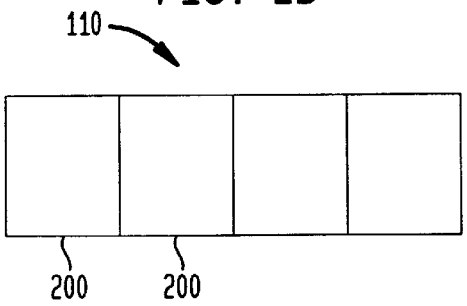

Because it is impossible to construct an ideal magic sphere, a segmented approximation, shown in FIG. 2C, is used. In such a configuration the magnetization is constant in both magnitude and direction within any one segment. With as few as eight segments per great circle of longitude, more than 90 percent of the ideal field strength is achieved. The greater the number of segments, the closer the approximation is to the ideal magic sphere.

There are several methods of making magic spheres, which are described in U.S. Pat. No. 5,337,472 issued to Leupold et al., and U.S. Pat. No. 4,837,542 issued to Leupold, both of which are incorporated herein by reference.

Figure 2E:
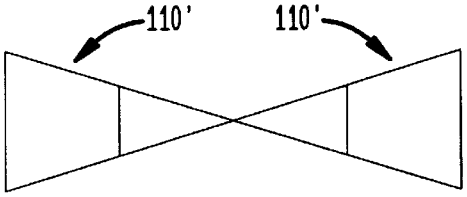
Figure 2F:
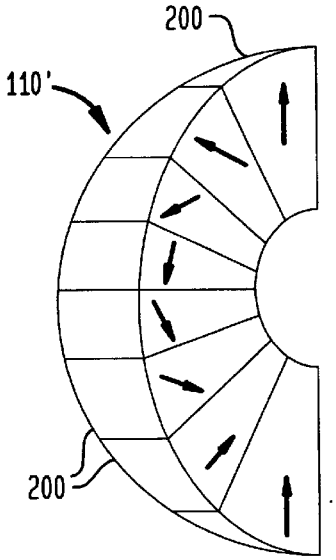
Figure 2G:
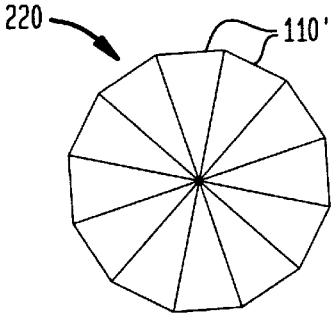

FIGS. 2D–2H show one method of constructing a magic sphere. Material is removed axially from ring 110. The amount of material removed increases along the axis of rotation to a maximum at a central point. Thus, the wedge shaped portions 110' are formed, as shown in FIGS. 2E and 2F. A plurality of rings 110 are processed in this way to form a plurality of wedge shaped portions 110'. The plurality of wedge shaped portions 110' are then assembled into a polyhedron approximation a magic sphere 220. FIG. 2G shows a top view of the magic sphere 220.

Figure 2H:
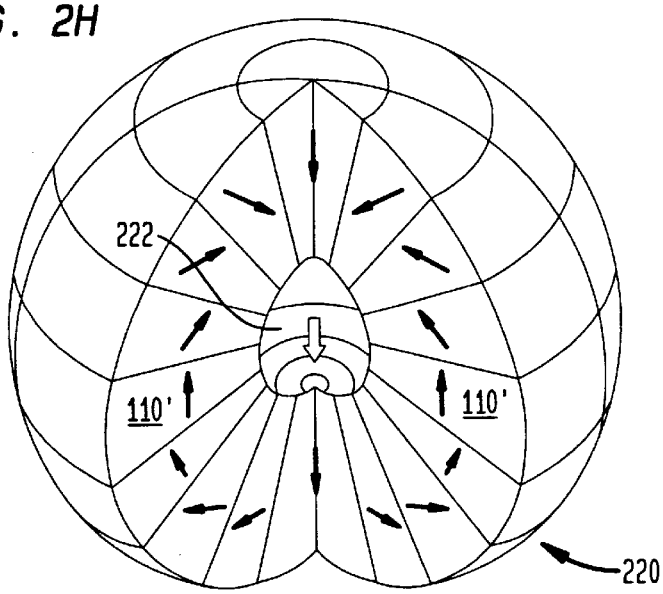

As a result, a relatively strong magnetic field is created in working space 222 at the center of the magic sphere 220, as shown in FIG. 2H. If a field of 20 kOe is desired in a central cavity of 1.0 cm in diameter, a magnetic material with a remanence of 12 kG, and an outer diameter of 3.49 cm can be used. This magic sphere only weighs 0.145 kg, which is an extraordinarily small mass for so great a field in that volume.

Magic Sphere Having An Augmented Magnetic Field

FIG. 3 shows a magic sphere having an iron core that increases, or augments, the strength of the magnetic field in the working cavity.

The working field H of magic sphere 320 is enhanced by using a passive magnet, such as iron, as inserts 370 and 392 in the cavities 380 and 394 of the magic sphere 320. The magic sphere 320 produces a uniform field H in the cavity, and creates magnetic excitations in the inserts 370 and 392. The excited passive magnet inserts, in turn, augment, or increase, that cavity field H produced by the magic sphere. Moreover, if the magic sphere is magnetized so that it saturates the passive magnetic inserts, or augmenting cores, the inserts will create maximum magnetic field augmentation in the cavity. In an alternative embodiment, permanent magnets may be used in place of passive magnets as inserts 370 and 392.

This concept of magnetically increasing, or augmenting, the field in the working cavity of a magic sphere is discussed in greater detail in U.S. Pat. No. 5,428,334; U.S. Pat. No. 5,428,335; and U.S. Pat. No. 5,382,936; all issued to Leupold et al., and incorporated herein by reference.

Northern and Southern Magic Hemispheres

Magic sphere 320 is comprised of two magic hemispheres, 330 and 390. Magic hemisphere 330 is a northern magic hemisphere, because the magnetic field in the working cavity passes from "north" to "south". In other words, the northern hemisphere 330 has a magnetic field which flows from the top of the hemisphere down through the equator, as illustrated by arrow M2. Magic hemisphere 390 is a southern magic hemisphere. The southern magic hemisphere 390 has a magnetic field that flows from the equator down through the bottom of the hemisphere, as illustrated by arrow M2. The magnetic field inside of the magic sphere 320 is therefore in the axial direction, perpendicular to the equator, flowing from northern hemisphere 330, through the equatorial gap 360, to southern hemisphere 390.

Magic Sphere Having An Equatorial Gap

Figure 3A:
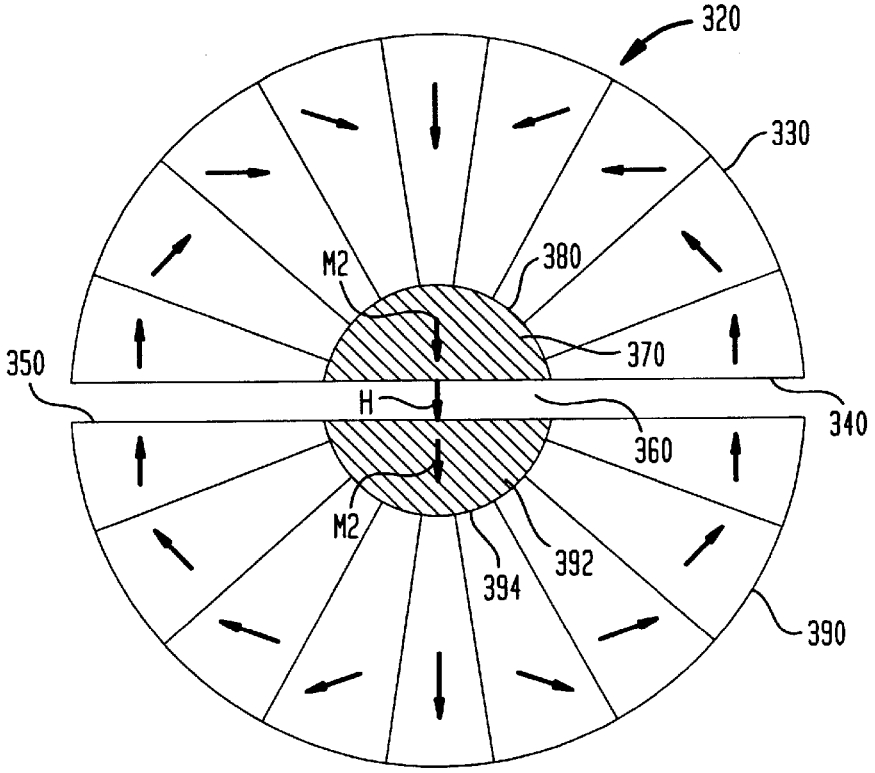
FIGS. 3A–3B show a magic sphere with an equatorial gap.

FIG. 3A shows an equatorial gap 360 that separates the equatorial surface 340 of the northern hemisphere 330 from the equatorial surface 350 of the southern hemisphere 390. The equatorial gap 360 is an empty space that physically separates the northern and southern magic hemispheres, but magnetically combines the magnetic fields produced by the northern and southern hemispheres. This physical separation of the hemispheres, with magnetic combination of the fields produced by the hemispheres, are essential features of the equatorial gap. FIG. 3A shows a full equatorial gap.

Figure 3B:
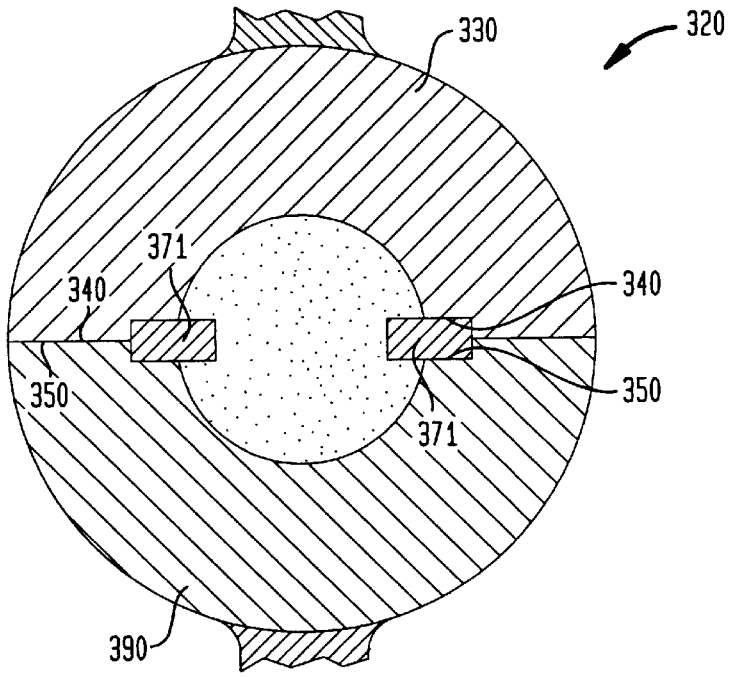

FIG. 3B shows that the two hemispheres may physically contact each other outside of the equatorial gap. FIG. 3B shows a partial equatorial gap. Equatorial gap 371 physically separates the two hemispheres and creates an empty space. The magnetic fields produced by the two magic hemispheres are combined in the equatorial gap. These equatorial gaps 360 (shown in FIG. 3A) and 371 (shown in FIG. 3B) are physically empty spaces that have a magnetic field. The equatorial gap is filled with a magnetically hard material that needs to be permanently magnetized by the magnetic field located in the equatorial gap.

The equatorial gap 360 has an adjustable gap thickness. The thickness is adjusted until it is equal to the thickness of the magnetically hard material that is received in the equatorial gap 360.

Radial Magnetic Field

Figure 4A:
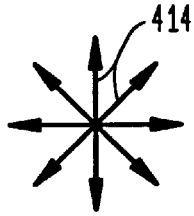
FIGS. 4A–4B show radial magnetic fields.
Figure 4B:
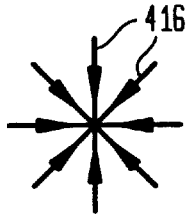

FIGS. 4A and 4B show radial magnetic fields in the plane of an equatorial gap. A radial magnetic field is a magnetic field that flows in a radial direction. A radial magnetic field can have one of two directions. The direction of the radial magnetic field can be outward, when two opposing northern hemispheres are used. When it is, the radial magnetic field flows away from the center point of a circle, as shown in FIG. 4A. The magnetic field of FIG. 4A extends radially, in an outward direction, as shown by arrows 414. This is an outwardly radial magnetic field.

The direction of the radial magnetic field can also be inward when two opposing southern hemispheres are used. The magnetic field of FIG. 4B is radial, with direction of the radial magnetic field flowing inward, toward the center of the circle, as shown by arrows 416. This is an inwardly radial magnetic field.

The radial magnetic field can a full radial magnetic field, as shown in FIGS. 4A and 4B, or a periodically radial magnetic field, as shown in FIG. 7 and discussed below.

Permanent Magnet Having a Radial Magnetic Field

Figure 4C:
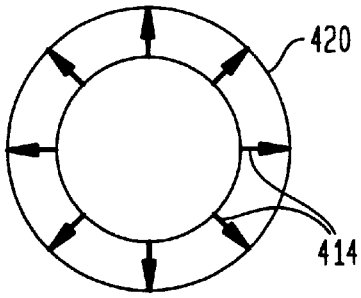
FIGS. 4C–4D show permanent magnets having radial magnetic fields.
Figure 4D:
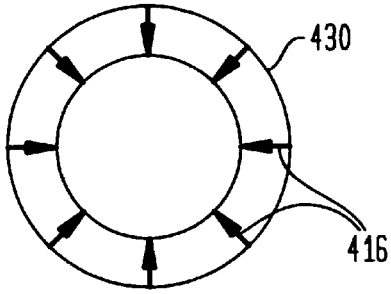

FIGS. 4C and 4D show permanent magnets having a radial magnetic field. The rings 420 and 430 are made of magnetically hard material. Radial magnetic field 414 is stronger than the coercivity of ring 420. When ring 420 is placed in field 414, it is permanently magnetized in an outwardly radial direction as shown in FIG. 4C. In a similar manner, ring 430, when placed in radial magnetic field 416, is permanently magnetized in an inwardly radial direction.

Radial Magnetic Field Located In The Equatorial Gap Of The Magic Sphere

Figure 5:
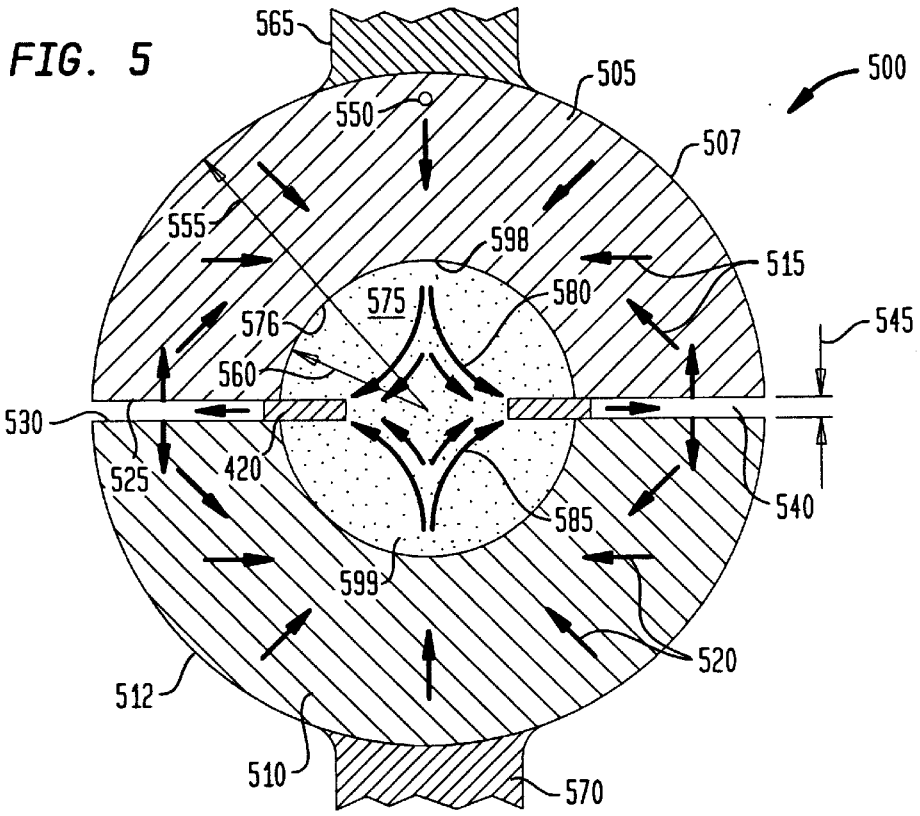
FIGS. 5–6 show a magic sphere having an equatorial gap and a radial magnetic field in the equatorial gap.

The radial magnetic field of FIG. 4A and the magnetic field in ring 420 is created with a magic sphere comprising two magic hemispheres having the same polarity, specifically two northern hemispheres. The radial magnetic field is located in an equatorial gap 540, as shown in FIG. 5. The field inside of the magic sphere extends radially outward, in the equatorial gap 540 of the magic sphere 500.

Northern magic hemisphere 505 is placed above northern magic hemisphere 510. The magnetic poles 550 of magic hemispheres 505 and 510 both point toward the equatorial gap 540. The magnetic fields 580 and 585 from these hemispheres cancel each other in the vertical direction, and add to each other in the radial direction.

The result is a magnetic field that extends radially along the equatorial gap 540 of the radial magic sphere 500. The radial magnetic field 414, located in equatorial gap 540 of magic sphere 500, is one novel feature of the present invention. The equatorial gap 540

This magic sphere is an outwardly radial magic sphere, because the magnetic field propagates in an outwardly radial direction. The strength of this radial magnetic field is larger than the coercivity of magnetically hard material 420. When magnetically hard material 420 is placed in this radial magnetic field, it becomes permanently magnetized in the radial direction as shown in FIG. 4C.

The equatorial gap 540 has an adjustable gap thickness 545. The thickness 545 is adjusted until it is equal to the thickness of the magnetically hard material 590 that is received in the equatorial gap 540.

Upper cavity 598 and lower cavity 599 define the central cavity 575 of the magic sphere. Radius 560 defines the common radius of the cavity 575. The magic sphere 500 may include magnetic material 576, such as iron, inside of the cavity 575, to augment the magnetic field produced by the magic sphere, as discussed in FIG. 3 and the accompanying text.

Nonmagnetic materials 565 and 570 are jigs that hold the magic hemispheres 505 and 510 in place. The jigs have connectors (not shown), such as fillet welds or threaded portions, for attaching the jigs to the magic hemispheres. Jigs 565 and 570 are also attached to an actuator (not shown). The actuator can be an electromechanical or hydraulic type actuator. The jigs and actuator can vary the size of the equatorial gap 540, so that the gap distance 545 equals the thickness of workpiece ring 590.

Figure 6:
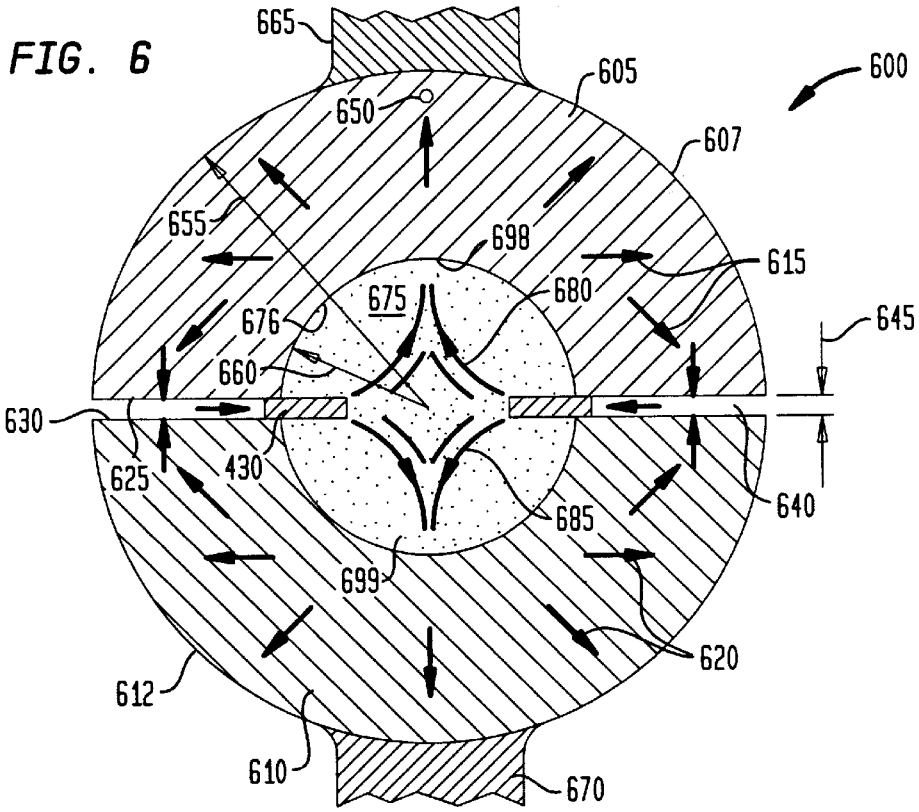

To create an inwardly radial magnetic field, two southern hemispheres are used to form an inwardly radial magic sphere. FIG. 6 shows a radial magic sphere comprised of two southern hemispheres. The resultant magnetic field in this case also exists only in a radial direction along the equator. However, the direction of the magnetic field is the opposite of the field shown in FIG. 5. The magnetic field extends radially along the equator, towards the center of the magic sphere. This radial magnetic field 416, located in the equatorial gap 640 of the magic sphere 600, is a novel aspect of the present invention.

When ring 430 is placed in the equatorial gap 640, inwardly radial magnetic field 416, located in the gap 640, permanently magnetizes the ring 430 as shown in FIG. 4D.

The equatorial gap shown in FIGS. 5 and 6 can be a full equatorial gap, as shown in FIG. 3A, or a partial equatorial gap, as shown in FIG. 3B.

Periodically Radial Magnetic Field

FIG. 7 shows an azimuthally periodic radial magnetic field. FIG. 7A shows a periodically radial magnetic field, where the strength of this radial magnetic field varies periodically, from strong to weak to strong. In the present invention, the strength of the radial magnetic field Hw varies periodically in the azimuthal direction from Hw>Hc, to Hw<Hc, where Hw is the strength of the working field, and Hc is the coercivity of the magnetic material that will be magnetized.

In other words, the strength of the magnetic field periodically changes. When the strength of the field Hw is stronger than the coercivity Hc of the magnetically hard material, then the field is strong enough to completely magnetize the hard material. When the strength of the field is smaller than the coercivity of the hard material, then the field will magnetize the material to a lesser degree. Therefore, any magnetically hard material that is placed in a periodically radial magnetic field will be periodically magnetized in a radial direction, as shown in FIG. 7B. The large arrows 760 show the areas of the ring that are permanently magnetized. The small arrows 761 show the areas of the ring that are only slightly magnetized. The areas with small arrows 761 are therefore not fully magnetized.

The ring 720 is one monolithic piece of magnetically hard material. The sections 770 and 771 of the ring are part of one monolithic ring. In other words, there is no physical division or separation between these sections. These sections 770 and 771 differ only in the strength of the magnetization.

Figure 7A:
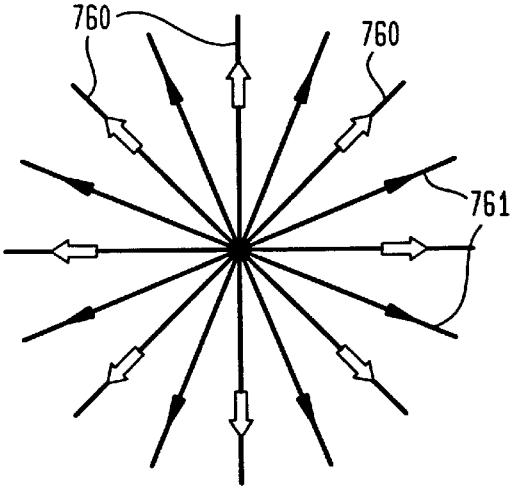
FIGS. 7A and 7C show periodically radial magnetic fields.
Figure 7B:
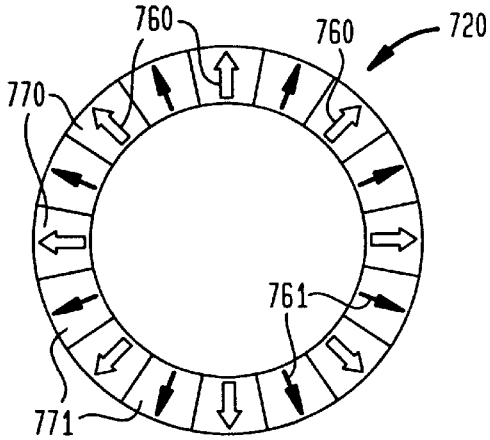
FIG. 7B shows a permanent magnet having a periodically radial magnetic field.
Figure 7C:
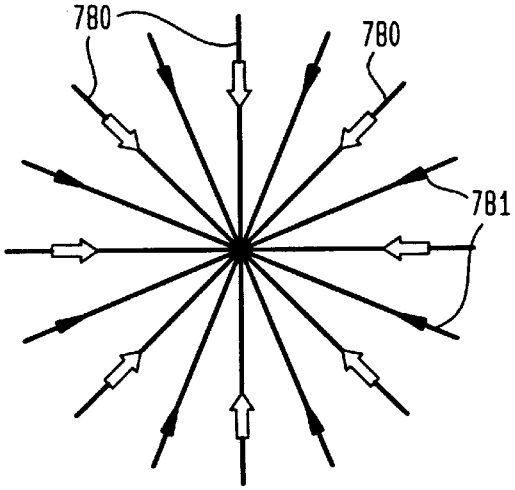

FIG. 7C shows an inward periodically radial magnetic field. The large arrows show where the radial magnetic field is strong enough to fully magnetize the magnetically hard material. The weak arrows show where a magnetically hard material, placed in this field, will not be fully magnetized.

Radial Magnetic Field Having Alternating Magnetic Directions

Figure 7D:
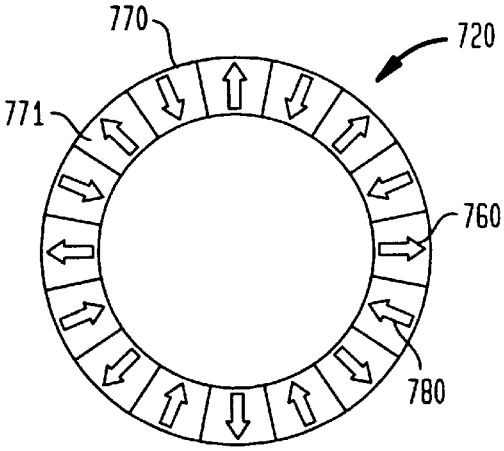
FIG. 7D shows a permanent magnet having a radial magnetic field with a periodically alternating direction.

FIG. 7D shows a ring that is radially magnetized. The strength of the magnetization is constant, but its direction periodically alternates between an inward and an outward direction. The ring 720 shown in FIG. 7D is one monolithic piece of magnetically hard material. The sections 770 and 771 are part of the monolithic, one-piece ring. The only difference between sections 770 and 771 is the direction of the magnetic field. A monolithic, one piece ring with a radial magnetic field having alternating magnetic directions is one novel feature of the present invention. This ring is produced by the following steps.

First, the ring 720 is placed in the azimuthally periodic radial magnetic field of FIG. 7A, so that it is magnetized as shown in FIG. 7B. Then, this same ring is then placed in the azimuthally periodic radial magnetic field of FIG. 7C, flowing in the opposite direction, so that areas 771 are placed in the large field 780, and areas 770 are placed in the small field 781. The magnetization of areas 770 is unchanged, because the applied magnetic field is not stronger than the coercivity of the magnetic material. However, the areas 771 are fully magnetized in the direction shown by arrows 780, because there the applied field is stronger than Hc so that the small magnetization there is reversed and fully brought to full value in the opposite (inward) direction. Therefore, the ring 720 is periodically magnetized in a radial direction, as shown in FIG. 7D.

Figure 9:
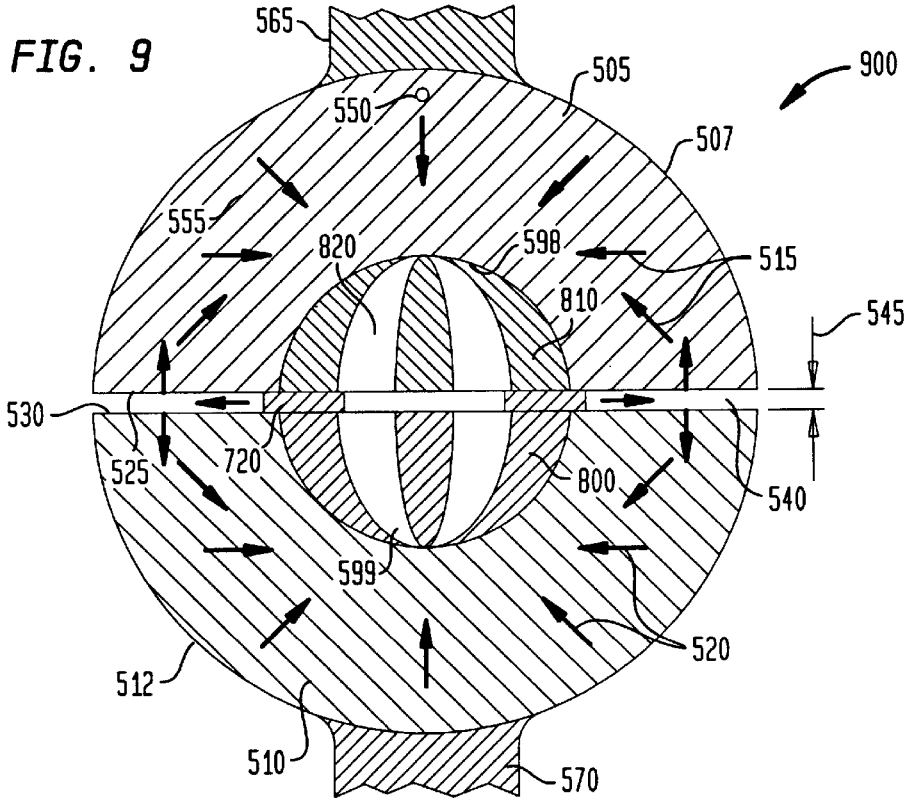
FIGS. 9 and 10 show a magic sphere having an equatorial gap and a periodically radial magnetic field in the equatorial gap.

Azimuthally Periodic Radial Magnetic Field Located in the Equatorial Gap of a Magic Sphere The device that produces the periodic magnetic field of FIG. 7A is a magic sphere having a periodically radial magnetic field, as shown in FIG. 9. The radial magnetic sphere of FIG. 5 produces a very high radial magnetic field, as shown in FIG. 4A. The strength of this radial field is increased when the cavity of the magic sphere is filled with an augmenting core 370, 392, as shown in FIG. 3, or core 576 as shown in FIG. 5.

Figure 8A:
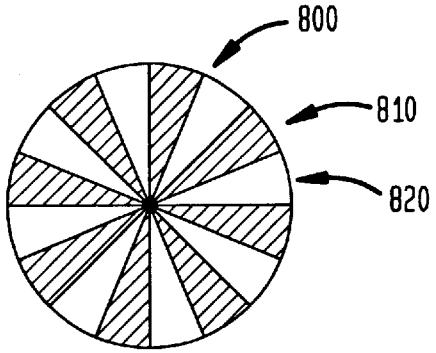
FIGS. 8A–8D show a modified augmenting core.
Figure 8B:
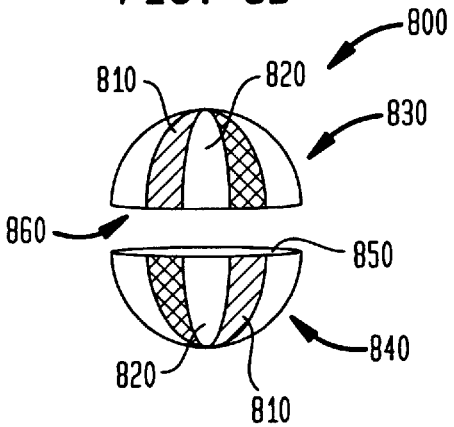
Figure 8C:
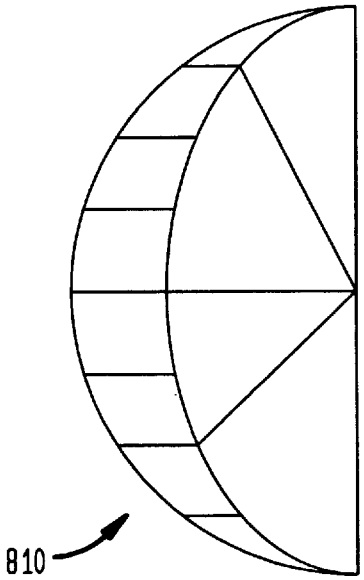

The radial magnetic field is periodically modulated by placing modified cores into the cavities 598, 599 of the magic sphere 900, as shown in FIG. 9. FIG. 8A shows a top view of this modified core. A sphere, which can be made of iron, (or some other passive or active magnetic material), is divided into "orange-slice" shaped wedges, or sections 810. Alternating "orange slices," or sections, of the sphere are removed, leaving empty spaces 820. This modified sphere is divided in half, into a lower core 840 having a lower equatorial surface 850 and an upper core 830 having an upper equatorial surface 860, as shown in FIG. 8B.

The lower core 840 has alternating grooves of empty space 820 and wedges of iron teeth 810. Likewise, upper core 830 has a plurality of iron wedges 810 with empty grooves 820 formed in between the wedges 810. The two cores 830, 840 of the modified iron sphere are placed into the cavities 598, 599 of the two northern magic hemispheres as shown in FIG. 9. Wedges 810 and grooves 820 of upper core 830 are in an oppositely facing, matching relationship to wedges 810 and grooves 820 of lower core portion 840. The equatorial surfaces 850, 860 define equatorial gap 540.

Figure 8D:
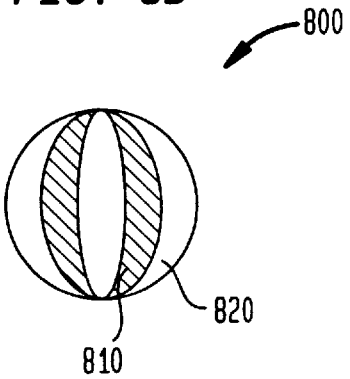

Alternatively, the modified core 800 does not have to be divided into an upper and lower core, as shown in FIG. 8D. The core 800 has alternating grooves 820 and wedges 810. The center of the modified core is partially cut at the equatorial gap. However, the equatorial gap is only large enough so that the magnetically hard material can fit into the equatorial gap, as shown in FIG. 3B. In this case, the equatorial gap of FIGS. 9 and 10 is the partial equatorial gap as shown in FIG. 3B.

The strength of the magnetic field passing through the cavities is increased when the magnetic field passes through the iron wedges of the modified iron sphere. However, the parts of the field that passes through the grooves, or empty spaces in the cavities are not increased. The magnetic field produced at the equator periodically changes from strong and weak, as shown in FIG. 7A. The strong magnetic field, shown by the large arrows 760, is larger than Hc. The weak magnetic field 761 is smaller than Hc.

A magnetically hard ring 720 that is placed in the magnetic field passing through the equator, as shown in FIG. 9, has portions of the ring 770 that are located under the iron wedges 810, in the strong magnetic field 760. Because this strong magnetic field is higher than the coercivity of the ring, these portions of the ring are fully magnetized. The ring also has sections 771 that are located under the grooves 820 in the weak magnetic field 761, where the field strength is much lower than the coercivity of the ring. These sections 771 of the ring are not fully magnetized. This ring is periodically magnetized in the radial direction as shown in FIG. 7B.

Figure 10:
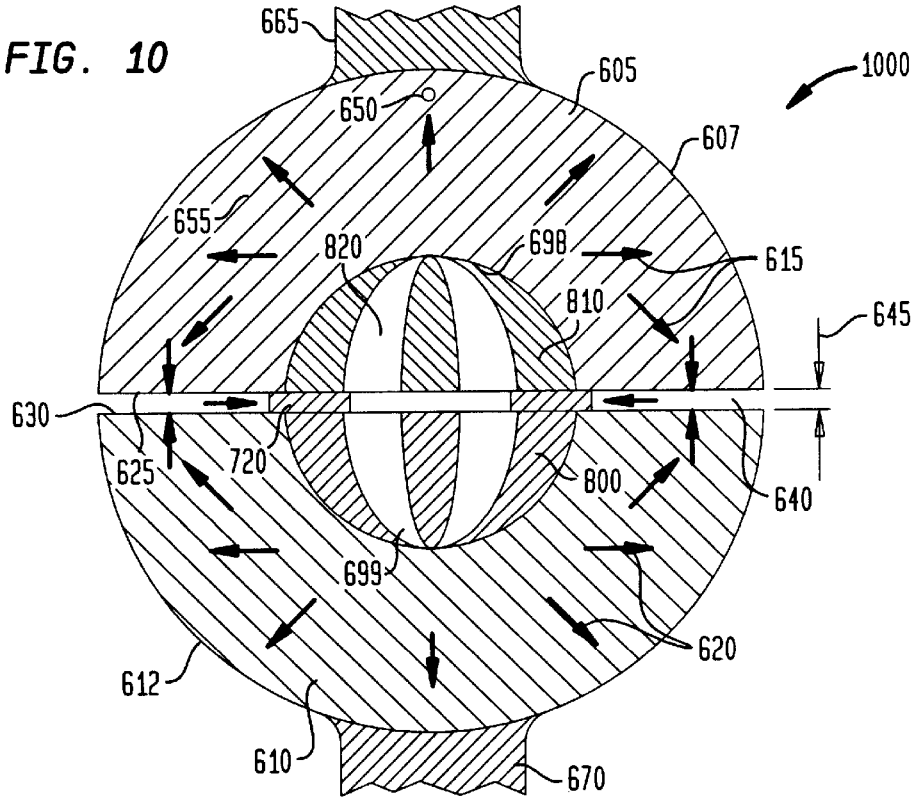

The ring 720 is then placed in the periodically radial magic sphere of FIG. 10, which has an inwardly periodic radial magnetic field. The modified iron cores shown in FIG. 8 placed in the cavities 698, 699 of the magic sphere 1000 to produce the periodic magnetic field of FIG. 7C. The portions of the ring 771 that are not fully magnetized are placed in between the iron wedges of the modified iron sphere, in the strong magnetic field 780. The sections of the ring 770 that are permanently magnetized are placed in between the grooves, in the weak magnetic field 781.

The ring is now permanently magnetized as shown in FIG. 7D.

I claim:

1. A radial magic sphere, comprising:

a magic sphere having an equatorial gap; and means for producing an azimuthally periodic radial magnetic field which field is located in the equatorial gap of the magic sphere.

2. The magic sphere of claim 1, wherein the means for producing an azimuthally periodic radial magnetic field comprises:

a core having grooves and wedges.

3. The magic sphere of claim 2, wherein the core comprises:

an upper core having grooves and wedges; and a lower core having grooves and wedges.

4. The magic sphere of claim 1, wherein:

the magic sphere further comprises an upper hemisphere having an upper cavity, and a lower hemisphere having a lower cavity.

5. The magic sphere of claim 4 wherein said means for producing an azimuthally periodic radial magnetic field is located in the cavities of the hemispheres.

6. The magic sphere of claim 4, wherein:

the upper and lower hemispheres are northern hemispheres.

7. The magic sphere of claim 4, wherein:

the upper and lower hemispheres are southern hemispheres.

8. The magic sphere of claim 1 wherein:

the direction of the azimuthally periodic radial magnetic field is outward.

9. The magic sphere of claim 1 wherein:

the direction of the azimuthally periodic radial magnetic field is inward.

* * * * *